United States Patent [19]

Fegley

[11] 4,202,471

[45] * May 13, 1980

[54] FLUID DISPENSING ANTI-BURGLAR BOOBY TRAP DEVICE

[76] Inventor: Charles R. Fegley, 1606 Frush Valley Rd., Laureldale, Pa. 19605

[ * ] Notice: The portion of the term of this patent subsequent to May 23, 1995, has been disclaimed.

[21] Appl. No.: 884,611

[22] Filed: Mar. 8, 1978

Related U.S. Application Data

[63] Continuation-in-part of Ser. No. 677,686, Apr. 16, 1976, Pat. No. 4,090,644.

[51] Int. Cl.[2] ..... B65D 83/14; B67D 5/32

[52] U.S. Cl. ..... 222/153; 222/180; 222/402.11; 222/402.14; 222/505; 239/274

[58] Field of Search ..... 222/153, 180, 402.11, 222/402.14, 402.15, 402.22, 402.21, 505, 509; 239/274; 109/20, 29

[56] References Cited

U.S. PATENT DOCUMENTS

| | | | |
|---|---|---|---|
| 2,772,819 | 12/1956 | Poarch et al. | 222/509 X |
| 3,081,918 | 3/1963 | Scoggin, Jr. et al. | 222/402.14 |
| 3,273,756 | 9/1966 | Levy et al. | 222/180 |
| 3,478,938 | 11/1969 | Krause | 222/402.14 |
| 3,806,000 | 4/1974 | Fegley | 222/180 |
| 3,899,105 | 8/1975 | Fegley et al. | 222/180 X |
| 4,090,644 | 5/1978 | Fegley | 222/180 |

*Primary Examiner*—Charles A. Marmor

[57] ABSTRACT

A fluid dispensing anti-burglar booby trap device is disclosed which discharges a fluid, containing a chemical such as tear gas, into an area to be protected when an intruder opens a window or door to enter an unauthorized area with which the device is associated. The anti-burglar booby trap device employs an actuating member for causing the discharge of a pressurized fluid container. The actuating member may be re-positioned to place the device in a safe, deactivated, inactuatable condition when desired.

8 Claims, 9 Drawing Figures

FLUID DISPENSING ANTI-BURGLAR BOOBY TRAP DEVICE

This application is a Continuation-In-Part of Ser. No. 677,686, filed Apr. 16, 1976, now U.S. Pat. No. 4,090,644.

BACKGROUND OF THE INVENTION

The invention relates generally to an anti-burglar booby trap device; more particularly to an anti-burglar device which dispenses a fluid such as tear gas from a pressurized container such as an aerosol container, into a protected area upon actuation by an unauthorized person. This action causes the protected area to be flooded with a chemical, thereby, forcing evacuation of the protected area by the intruder; however, the invention is not limited to the use of the aerosol type container.

Chemical weapons have been known in the art for many years. One type of chemical weapon is the conventional tear gas grenade in which the firing member is generally triggered manually and the grenade is manually hurled at a target area, causing the target area to be flooded with the chemical irritant.

In another type of chemical weapon, the chemical irritant is stored under pressure in an aerosol type container. The firing member is again generally triggered manually and the chemical irritant in the form of a spray is manually directed at a target.

A third type of chemical anti-burglar device discharges an explosive tear gas shell into an area but this type is both dangerous and very limited as to the amount of tear gas which is discharged into the area to be protected.

Thus, what is needed is an anti-burglar device of the fluid dispensing booby-trap type which can be actuated by a small amount of mechanical force, yet will release a sufficient amount of fluid containing a chemical into a given area to force evacuation of an intruder. The anti-burglar device uses a container of pressurized fluid having a fluid-dispensing element which is actuated by an actuating member. The actuating member will actuate the dispensing element when a force is applied to the actuating member. Such a force may be the force of an opening door or window sash. By movement of the actuating member or parts thereof, the actuating member can be placed in a position so that the dispensing element cannot be accidentally actuated. When the device is triggered by an intruder moving a door or window sash, the actuating member causes actuation of the dispensing element to release a sufficient volume of a fluid such as tear gas from the pressurized container into the protected area to force evacuation of the intruder.

SUMMARY OF THE INVENTION

The principal object of the present invention is to provide an anti-burglary device of the fluid dispensing type which may be triggered directly by a small amount of mechanical movement, and yet may easily be placed in a non-actuatable condition.

An additional object of the invention is to provide an anti-burglar device of the chemical weapon type which is readily triggered by opening a door or other entry means by an intruder entering an unauthorized area.

Another object of the invention is to provide an improved means of discharging a fluid containing a chemical such as tear gas into the protected area in a minimum amount of time in order to force the intruder from the protected area and to prevent the intruder from reentering the protected area for a reasonable amount of time.

Yet another object of the invention is to provide an anti-burglar device having means for reloading the device and resetting the actuating member of the weapon to its actuatable position after the device has been discharged. According to the principal aspect of the present invention, there is provided an improved means of actuating the fluid-dispensing element of an aerosol container. One such means is an actuating member mounted in relation to the fluid-dispensing element, whereby the fluid-dispensing element is actuated by the actuating member when moved by an object with which the invention is associated, when the actuating member is so positioned for such movement. The actuating member may be positioned so that it will allow an object such as a door to be moved freely without causing movement of the actuating member. Since the actuating member may be mounted relative to the dispensing element with mechanical advantage, the device can require little force for operation.

The body member of the invention is structured to support a pressurized container having a fluid-dispensing element whereby movement of the actuating member which is mounted relative to the fluid-dispensing element causes discharge. The device may be placed in a safe non-actuatable condition by moving the actuating member wherein it cannot actuate the fluid-dispensing element.

When actuated by the moving object, with which the device is associated, the object must remain in the actuated position to cause discharge. One means to retain the fluid dispensing element in the discharge position is illustrated as a spring detent which will retain the actuating member in its discharge position.

The anti-burglar device utilizing such a fluid-dispensing element aerosol container may be structured to include a separate moveably mounted actuating member which can be moved from a safe non-actuatable position to an actuatable position for actuation by a moving object with which the device is associated. This type of actuating member requires a locking means whereby the device is locked in its actuated position, once actuated by the moving object, such as a door. This is accomplished by a spring biased catch associated with the actuating member which snaps into a locking position to prevent the return movement of the actuating member.

The anti-burglar device of the present invention may be utilized in homes, factories, farms, office buildings by attaching the device to doors, windows, skylights, etc. and may be used in connection with vehicles such as boats, trucks, etc. The device may also be employed for any other application wherein it is desired to prevent unauthorized persons from moving certain objects by mounting the device in such a manner that unauthorized movement of the objects will cause actuation.

Once actuated, the discharge cannot be stopped by the intruder and the entire amount of pressurized fluid will be discharged into the protected area making it impossible for the intruder to remain in the protected area without having protective equipment.

Other objects, aspects, and advantages of the invention will become apparent from the following description taken in connection with the accompanying drawings.

DESCRIPTION OF THE PREFERRED EMBODIMENTS

Figure 1:
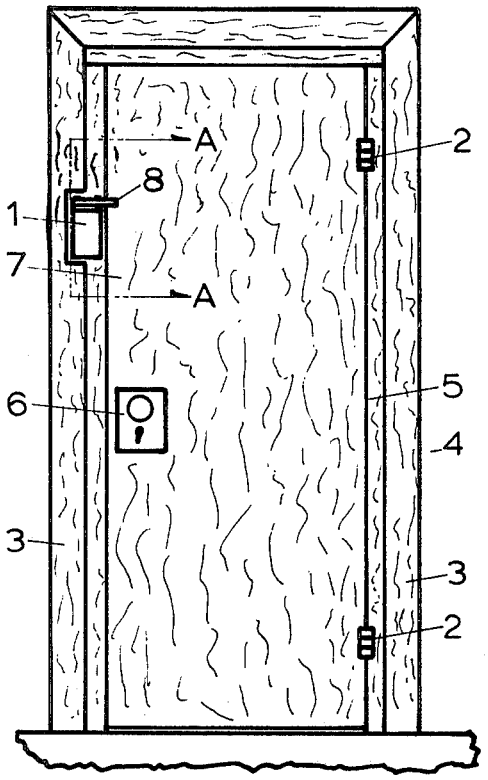
FIG. 1 is an elevational view of a wall of a room showing an embodiment of the fluid dispensing anti-burglar device mounted on a door frame for actuation by an unauthorized movement of the door.
Figure 4:
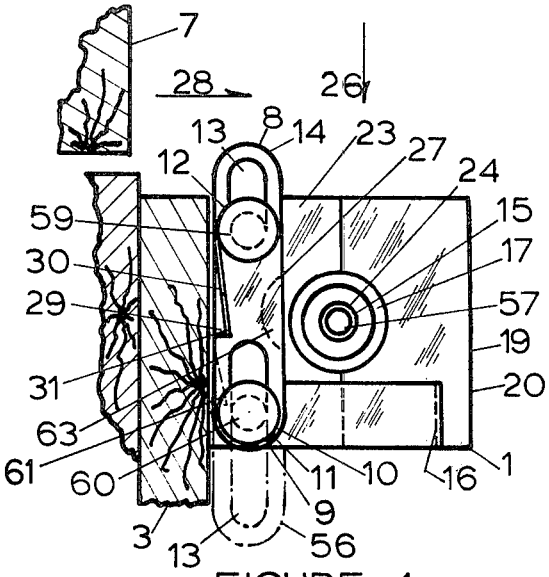
FIG. 4 is a top elevational of the device in its ready-to-be actuated position.

Referring now to the drawings in detail, wherein like reference characters designate like parts throughout the various views, there is shown in FIGS. 1–5, one form of the fluid dispensing anti-burglar booby trap device, called device hereafter, of the fluid dispensing type according to the present invention, generally designated 1. The device 1 is shown for convenience as being secured to a surface such as a door frame 3 in wall 4 whereby the device can be actuated by a second surface such as the door 7 upon opening of the door 7 by an intruder. The device 1 will discharge a fluid 25 containing a chemical such as tear gas into the restricted area when actuated.

Figure 2:
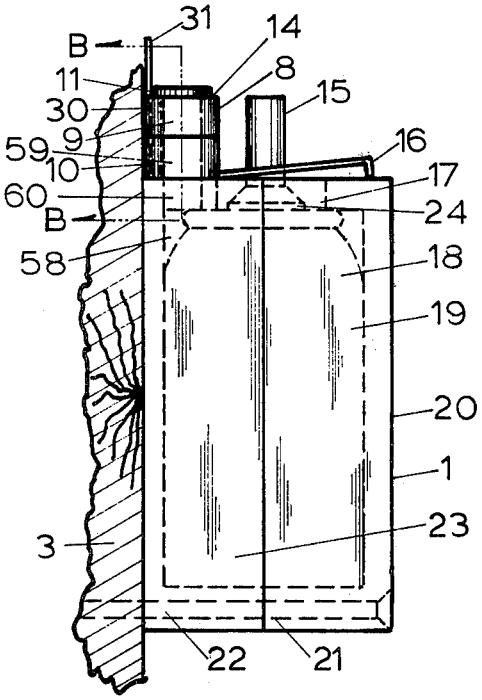
FIG. 2 is a left side elevational view of the device as taken along line A—A of FIG. 1.
Figure 3:
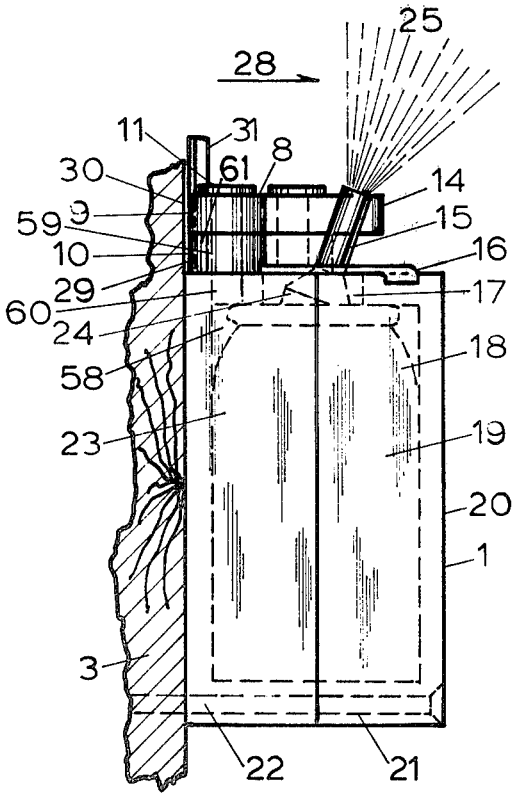
FIG. 3 is a left side elevational view of the device as taken along line A—A of FIG. 1 wherein the device is actuated and fluid is discharged.
Figure 5:
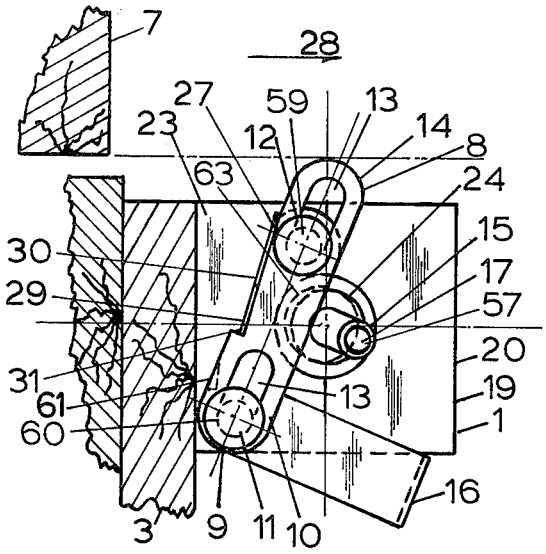
FIG. 5 is a top elevational of the device in its actuated position wherein fluid is discharged.

The device 1, whose side is shown in FIGS. 2 and 3, contains a container of pressurized fluid, called pressurized container 18 hereafter, supported in a body member 20. The body member 20 is shown for convenience as being comprised of a front body half 19 and a rear body half 23 and includes mounting means which is shown for convenience as holes 22 through body member 20 for attaching device 1 to a first surface shown as the door frame 3 or elsewhere as may be convenient with screws 21.

Figure 6:
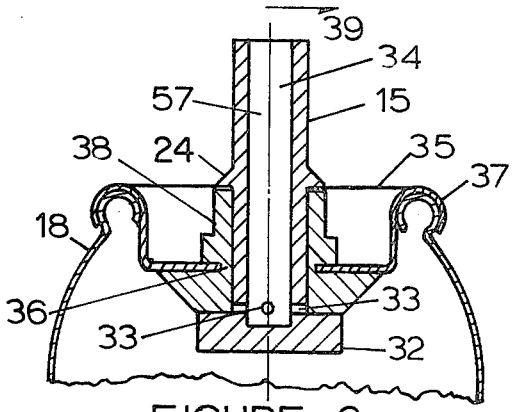
FIG. 6 is a partial vertical sectional view of the container valve assembly.

As best seen in FIGS. 2–5, the body halves 19 and 23 when assembled form the pressurized container cavity 58 and cylindrical hole 17. The pressurized container 18 is supported in the cavity 58. One type of pressurized container 18 is shown as having a fluid-dispensing element 15 for use with the valve assembly generally designated 24. Valve assemblies of this type are well known in the trade and one type of valve for use in this embodiment is shown in FIG. 6. The valve assembly 24 is shown in FIG. 6 and is comprised of a projecting fluid-dispensing element 15 which has a hollow tube portion 34 and is closed at the valve end 32 thereof. The fluid-dispensing element 15 is mounted in the hole 36 of the formed valve mounting container cover 35 by the grommet-like seal 38. The formed valve mounting container cover is attached to container 18 by the crimped seal 37. The hollow tube portion 34 of the fluid-dispensing element 15 has at its sealed valve end 32 four small discharge holes 33 so that when the dispensing element 15 is tilted from its normal position in any direction 39 the valve end 32 of the fluid-dispensing element 15 will part from the seal 38 on the side facing the direction 39 and allow the fluid 25 to flow between the valve end 32 and seal 38 through one or more of the discharge holes 33 and through the tube portion 34 of the fluid-dispensing element 15 into the area being protected. If the fluid-dispensing element 15 is allowed to return to its normal position the valved end 32 thereof again fully engages the seal 38 to prevent fluid flow. It is therefore readily seen why once tilted, the fluid-dispensing element 15 must be kept in that position until the container's contents has been dispensed.

Now referring to FIGS. 2–5, there is shown a means for actuating the fluid dispensing element 15 by an element actuating means generally designated as actuating means 8 and is generally shown in its actuatable and actuated positions. The element actuating means 8 consists of a slidably mounted trigger element 9 mounted on a trigger pivoting element 10. The pivot and slide pin 11 and slide pin 12 secure the slidable trigger element 9 to the trigger pivoting element 10 through slots 13 of the trigger element 9 and pressed into pivot pin hole 60 of back body half 23 and slide pin hole 59 of the trigger pivoting element 10. The trigger element 9 may be moved between the actuable position shown in FIGS. 2–5 and the free access position 56 shown in FIG. 4, indicated dotted. In the free access position 56 the trigger element 9 of element actuating means 8 cannot be acted upon by the door 7 moving in direction 28 to actuate the device 1.

As shown in FIGS. 2–5, the slidable trigger element 9 is provided with a means for holding the trigger element 9 in its actuatable position 14. The holding means is shown as a spring latch 30 which enters into the notch 29 of trigger pivoting element 10 when the trigger element 9 is moved to its actuatable position 14 to prevent the trigger element 9 from sliding to its inactuatable position 56. When it is desired to move the trigger element 9 to its inactuatable position 56, pressure is applied to the extension 31 on latch spring 30 to remove the latch spring 30 from notch 29, thereby permitting the trigger element 9 to be moved in the direction 26 to its inactuatable position 56. When the trigger element 9 is in its inactuatable position 56, the latch spring 30 acting on pivot trigger element 10 through friction against the pivotable trigger element 10 to prevent the trigger element 9 from accidentally moving to the actuatable position 14. If it is desired, a second notch 61 may be added to the pivotable trigger element 10 to hold the trigger element 9 in position.

The trigger element 10 provides a means for slidably mounting the trigger element 9. A retaining means 16 to retain the trigger-actuating means 8 and therefore hold the fluid-dispensing element 15 in an actuated, dispensing condition to completely dispense the fluid 25 from the pressurized container 18 when the element actuating means is moved is shown in FIGS. 2–5. It can be seen that the trigger element 9 when in the actuatable position will be moved by the door. The trigger element 9 of the element actuating means 8 will rotate the actuating means 8 in direction 28 thereby moving the dispensing element and causing fluid discharge. Once the door 7 has moved the actuating means 8 far enough to fully actuate the dispensing element 15 in direction 28, the actuating member retaining means 16 is spring biased to move to the retaining position seen in FIGS. 3 and 5. The projection 16 engages the one side of the front body half 19 of body member 20 to retain the actuating member 8 in a dispensing condition to dispense the fluid contents 25 of pressurized fluid container 18.

Figure 7:
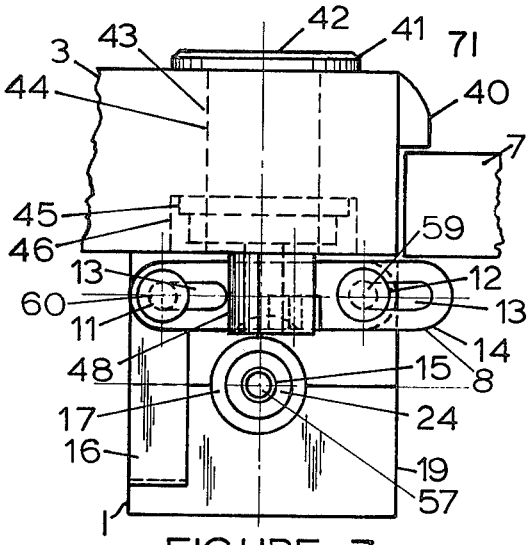
FIG. 7 is a top elevational showing an embodiment wherein the device may be placed into and out of position for actuation by a lock means.
Figure 8:
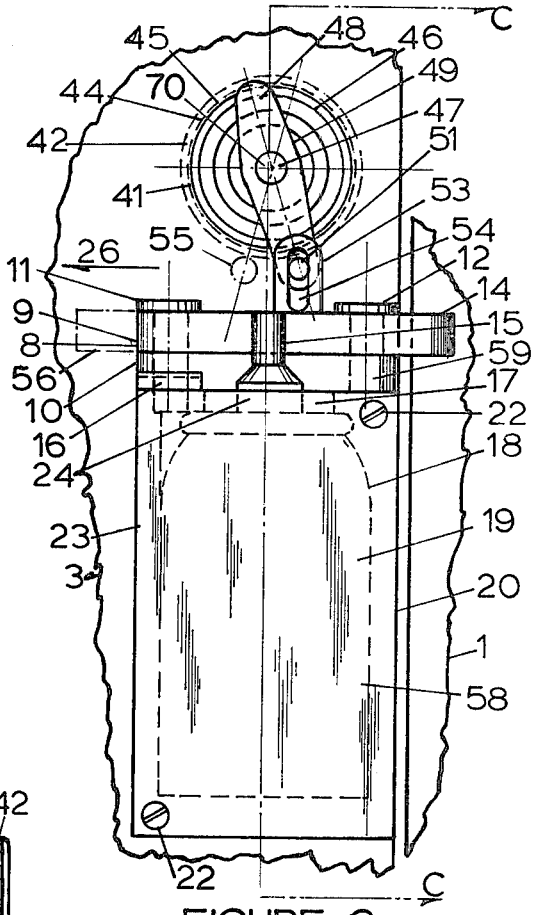
FIG. 8 is a front elevational of FIG. 7.
Figure 9:
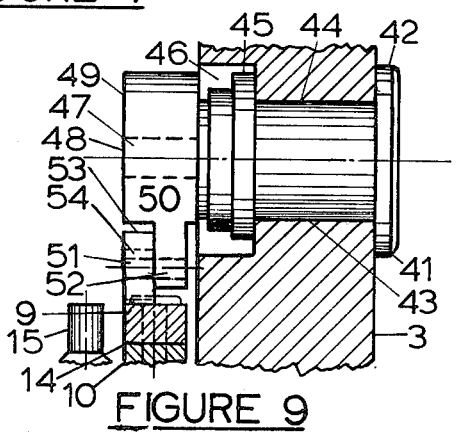
FIG. 9 is a partial sectional taken along line C—C of FIG. 8.

A second embodiment of the invention is illustrated in FIGS. 7–9. In this embodiment the basic structure is as previously described and like numbers are used to indicate like or corresponding parts. The basic structure has been modified to include a means for controlling the position of the actuating member 8 from a position outside the protected area with which the device 1 is associated.

In this embodiment, the pressurized container 18 and the dispensing element 15 thereof, function to operated the valve assembly 24 as previously described, the major differences being the additional means for controlling the position of the slidably mounted trigger element 9 from position outside the protected area with which the device 1 is associated. As shown in FIGS. 7–9, the sliding trigger element 9 may be placed into an actuatable position 14 or a inactuatable position 56 by a means for controlling the position of the slidable trigger element 9 from outside the protected area with which the device is associated. The means for controlling the slidable trigger element 9 is shown for convenience as a cylinder lock 41 mounted in a hole 43 through frame 3.

It is important that the cylinder lock 41 have means for attaching a thumb latch lever, generally designated 48, to it, wherein the thumb latch lever 48 can be moved by a key when a key is inserted and turned in the cylinder lock. It is also important that the length of the cylinder lock be long enough to extend from a surface outside the protected area into the protected area so that the device 1 can be placed in an actuatable position 14 or an inactuatable position 56 from outside the protected area.

The thumb latch lever 48 may be attached for movement to the cylinder lock 41 in many ways. For convenience, the cylinder lock 41 is shown with a shaft extension 47 which is rotated by a key inserted at 42 and the key rotated to turn the shaft 47 and thumb latch lever 48.

The slidable trigger element 9, in this embodiment, has a vertical extension 53 containing a slot 54. The lower portion 50 of the thumb latch lever 48 has pin 51 mounted on it. The pin 51 of the thumb latch lever 48 is inserted into slot 54 of the trigger element 9.

The slidable trigger element 9 may now be placed in either position by rotating either the thumb latch lever 48 or by inserting a key in the cylindrical lock 41, and rotating it to its desired position. The device is then actuated as described in the first embodiment.

The embodiments herein show the pressurized container having the fluid-dispensing element positioned in the upmost position for use with fluids in gaseous form. It is recognized that by inverting the device, fluids in liquid form may be discharged.

Although I have herein shown and described the invention in what I have conceived to be the most practical and preferred embodiments, it is recognized that the scope of my invention, which is not to be limited to the details disclosed herein but is to be accorded the full scope of the claims so as to embrace any and all equivalent structures and devices.

I claim:

1. A fluid-dispensing anti-burglary booby trap device for attachment to a first surface such as a wall wherein said device is associated with a second surface such as a door and arranged such that movement of said second surface will cause said device to dispense a fluid such as tear gas in the event unauthorized movement of said surface is attempted, the device comprising:

(a) a body member;

(b) a container of pressurized fluid supported in said body member, said container having a fluid-dispensing element adapted to release fluid under pressure when actuated;

(c) a passageway in said fluid-dispensing element for directing fluid from said container;

(d) means for actuating said fluid-dispensing element, said dispensing element actuating means mounted for movement and associated with said fluid-dispensing element and said second surface, said dispensing element actuating means actuating said fluid-dispensing element when it is moved by said second surface thereby causing fluid discharge;

(e) means for movably positioning said dispensing element actuating means whereby said dispensing element actuating means may be moved between an inactuatable position and an actuatable position, said dispensing element actuating means in said inactuatable position permitting movement of said second surface without causing movement of said dispensing element actuating means, said dispensing element actuating means when in said actuatable position being in position to be moved upon movement of said second surface;

(f) mounting means associated with said body member for fastening said body member to said first surface, said body member arranged on said first surface relative to said second surface whereby movement of said second surface from a first position to a second position will engage with and move said dispensing element actuating means when said dispensing element actuating means is in said actuatable position, said dispensing element actuating means including means for retaining said dispensing element actuating means in engagement with said fluid-dispensing element when said dispensing element actuating means is moved by said second surface, said retaining means including a spring biased projection attached to and moved by said dispensing element actuating means wherein said spring biased projection engages said body member upon movement of said dispensing element actuating means to retain said dispensing element in said discharge position.

2. The fluid-dispensing anti-burglar device of claim 1 wherein said fluid-dispensing element includes a dispensing valve which is actuated upon movement thereof.

3. The fluid-dispensing anti-burglar device of claim 1 wherein said fluid-dispensing element includes a projecting dispensing spout, said dispensing spout discharging fluid upon movement thereof.

4. The fluid-dispensing anti-burglar device of claim 1 wherein said means for movably positioning said element actuating means includes pivotably mounting said dispensing element actuating means on said body member, said element actuating means comprising a sliding extension movable between said inactuatable and said actuatable position.

5. The fluid-dispensing anti-burglar device of claim 4 wherein said element actuating means includes a means for releaseably retaining said actuating means in said actuatable position.

6. The fluid-dispensing anti-burglar device of claim 4 wherein said element actuating means includes a means for latching said element actuating means in said actuatable position or said inactuatable position.

7. The fluid-dispensing anti-burglar device of claim 1 and means for controlling the position of the element actuating means from either side of the first surface with which the device is associated.

8. The fluid-dispensing anti-burglar device of claim 1 and means for moving the element actuating means between said actuatable position and said inactuatable position by a locking means, said locking means positioned on the opposite side of the first surface from which the device is mounted.

* * * * *